US007888569B2

(12) United States Patent
Penic

(10) Patent No.: US 7,888,569 B2
(45) Date of Patent: Feb. 15, 2011

(54) SHOULDER REST FOR A VIOLIN AND VIOLA

(76) Inventor: Avgustin Penic, Vegova 18, Celje (SI) 3000

( * ) Notice: Subject to any disclaimer, the term of this patent is extended or adjusted under 35 U.S.C. 154(b) by 0 days.

(21) Appl. No.: 11/918,563

(22) PCT Filed: Apr. 18, 2006

(86) PCT No.: PCT/SI2006/000012

§ 371 (c)(1),
(2), (4) Date: Mar. 16, 2009

(87) PCT Pub. No.: WO2006/110114

PCT Pub. Date: Oct. 19, 2006

(65) Prior Publication Data

US 2009/0211426 A1 Aug. 27, 2009

(30) Foreign Application Priority Data

Apr. 15, 2005 (SI) ..... P-200500110

(51) Int. Cl.
*G10D 3/18* (2006.01)

(52) U.S. Cl. ..... 84/280; 84/278; 84/281

(58) Field of Classification Search ..... 84/278, 84/280, 281
See application file for complete search history.

(56) References Cited

U.S. PATENT DOCUMENTS

| | | | | | |
|---|---|---|---|---|---|
| 2,208,824 | A * | 7/1940 | Weinberg | ..... | 84/280 |
| 2,483,052 | A * | 9/1949 | Humphrey | ..... | 84/280 |
| 2,746,336 | A * | 5/1956 | Bisharat | ..... | 84/280 |
| 3,728,928 | A * | 4/1973 | Looser et al. | ..... | 84/280 |
| 4,333,378 | A * | 6/1982 | Hrdlicka | ..... | 84/280 |
| D352,053 | S * | 11/1994 | Murray | ..... | D17/20 |
| 5,567,893 | A * | 10/1996 | Kun | ..... | 84/280 |
| 5,731,531 | A * | 3/1998 | Kun | ..... | 84/280 |
| 6,369,303 | B1 * | 4/2002 | Hvezda | ..... | 84/278 |
| 6,670,533 | B1 * | 12/2003 | Yeh | ..... | 84/278 |
| 6,680,431 | B2 * | 1/2004 | Vanden et al. | ..... | 84/279 |
| 6,891,093 | B2 * | 5/2005 | Huang | ..... | 84/278 |
| 6,927,329 | B2 * | 8/2005 | Chen | ..... | 84/279 |
| 7,265,284 | B2 * | 9/2007 | Muir et al. | ..... | 84/279 |
| D561,236 | S * | 2/2008 | Muir et al. | ..... | D17/20 |
| 7,385,124 | B2 * | 6/2008 | Clemente | ..... | 84/278 |
| 2009/0211426 | A1 * | 8/2009 | Penic | ..... | 84/280 |

* cited by examiner

*Primary Examiner*—Jeffrey Donels
*Assistant Examiner*—Robert W Horn
(74) *Attorney, Agent, or Firm*—The Watson I.P. Group, PLC; Jovan N. Jovanovic; Vladan M. Vasiljevic

(57) ABSTRACT

The shoulder rest for a violin and a viola is formed in the manner that the basis of the shoulder rest (1) is partially rolled up in the opposite direction and that enables maximal adjustment to physiological characteristics of the violinist. The strain leg holder (2) is rotated for 180° C. in each direction in the way that the shoulder rest length is reduced from the functional shoulder rest length for one fourth.

2 Claims, 4 Drawing Sheets

SHOULDER REST FOR A VIOLIN AND VIOLA

The invention belongs to a field of musical instruments and musical tools.

A shoulder rest for a violin and a viola is a tool that enables fastening of an instrument—violin or viola—in the position of human body that the musician—violinist or violist can hold the instrument freely between the chin and the shoulder and it enables a smooth, relaxing and thus optimal playing the instrument.

All known shoulder rests for a violin and a viola of different shapes have solved the problems of fixing the shoulder rest in different ways so far. But there are many problems that are still not solved:

a shoulder rest during the play falls off the instrument a shoulder rest moves away from the basic position and it touches the bottom of the violin when pressing strongly on the shoulder and that can damage lacquer on the back side of the instrument.

Limited positions of the shoulder rest on the instrument do not enable a needed support on the wished part of the shoulder because the ideal point of support is difficult to get due to the fact that if we move the shoulder rest in the direction where the support is optimal, the shoulder rest can fall from the instrument.

Putting the shoulder rest into a violin suitcase can be difficult because its basic shape is usually overdimensioned with an increased possibility of regulation of the shoulder rest. In the suit case the space for the shoulder rest is limited that is why the possibility of putting the rest together can be very welcome. Only a few shoulder rests offer this possibility at present, but putting the rest together is so far available only according to the height of the rest.

Different shoulder rests so far that could have not enabled putting the rest together along the longitudinal axis and as such no one reduces the length of the shoulder rest at the same manner as the new shoulder rest.

The invention of the new rest for holding a violin or a viola enables a regulation adjustment in all directions, according to the height, length and depth. By means of this new shoulder rest the adjustment of an instrument is assured according to the physiological characteristics of each musician. Among them there is a hold of an instrument in the way which—without any adjustment possibilities—holding of an instrument causes pains in the back and neck of the body. After several years of playing and holding an instrument in the wrong positions serious damages of back and neck can occur.

So far unsolved problem can be solved with this invention—it is the possibility of adjustment of the shoulder rest even according to the depth in the field of 360 degrees. It is called lateral adjustment. The shoulder rest is fixed on the instrument and can be regulated in the manner that the violinist finds the optimal position of the instrument according to his or her needs.

Figure 1:
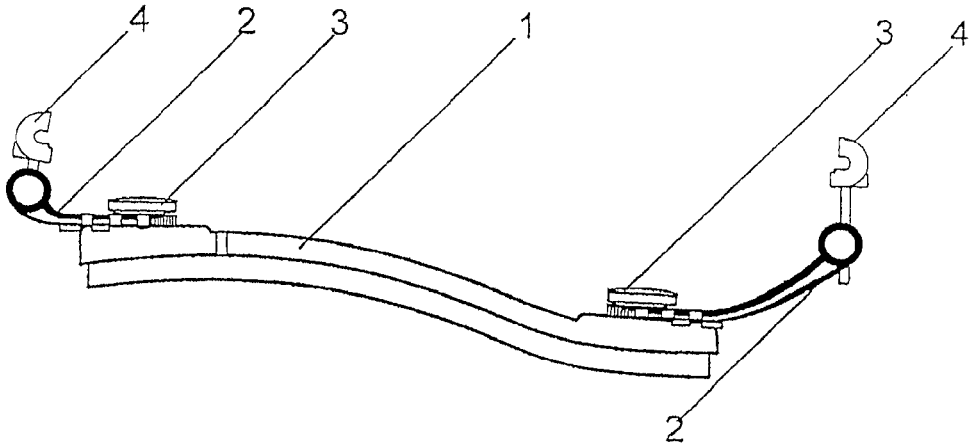

The invention is described in the accomplished case and in figures:

FIG. 1—the shoulder rest according the invention—compositional figure

Figure 2:
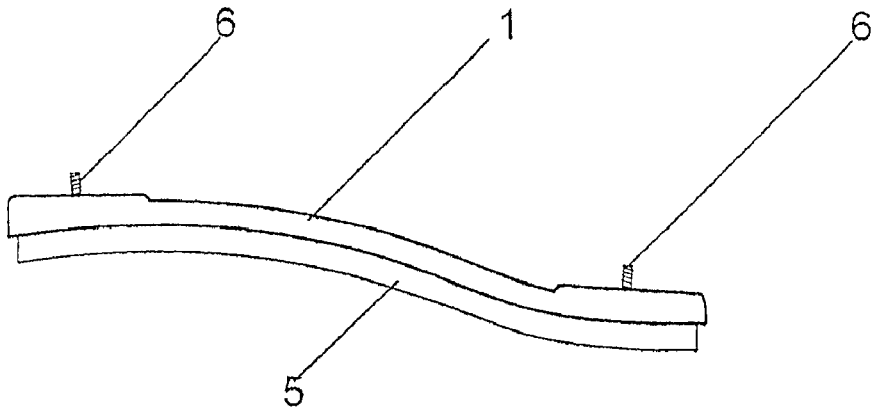

FIG. 2—basis of shoulder rest

Figure 3:
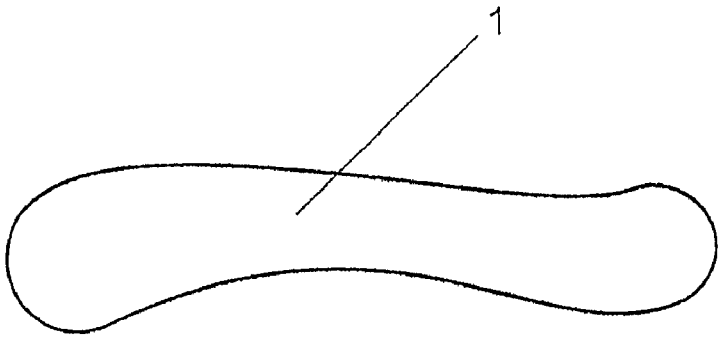

FIG. 3—shape of the basis of shoulder rest—ground plan

Figure 4:
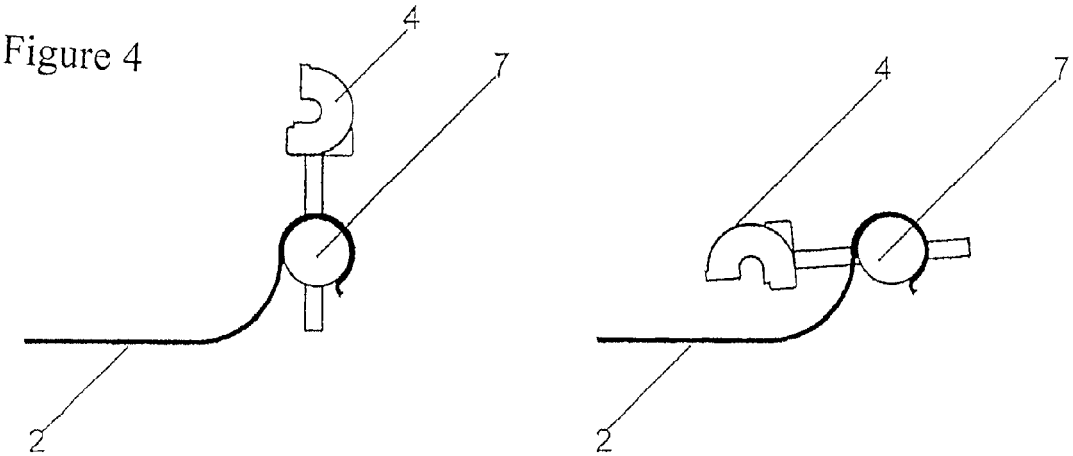

FIG. 4—compositional figure of the strain leg holder

Figure 5:
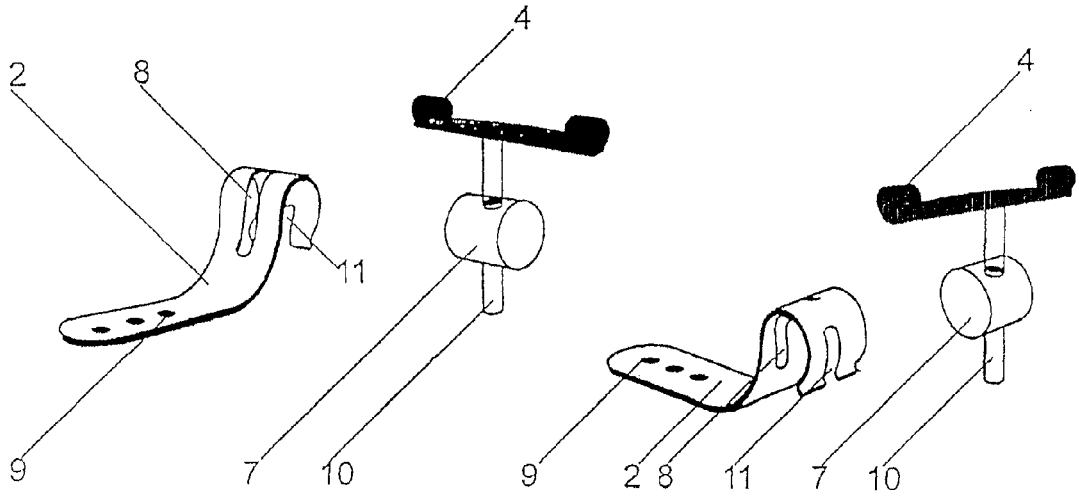
Figure 6:
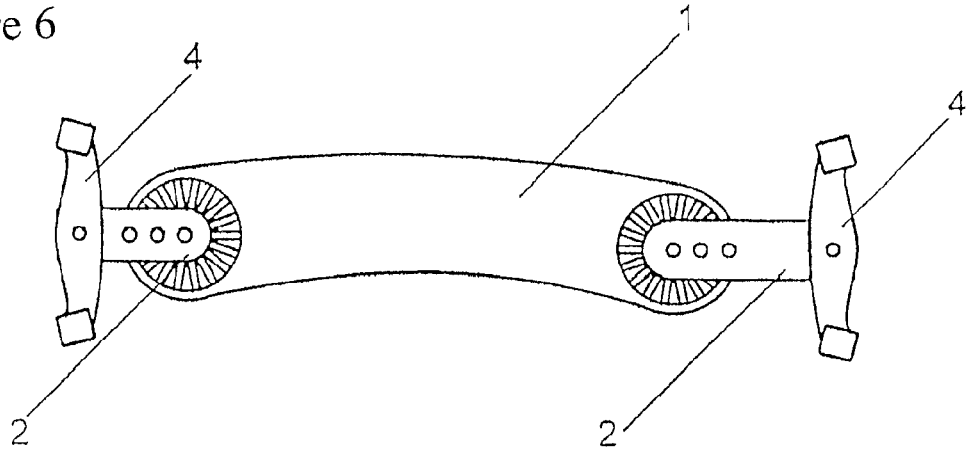
Figure 7:
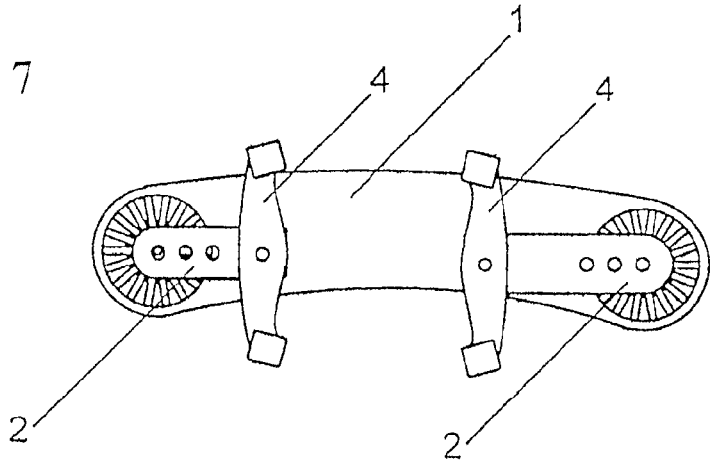

FIG. 5—showing the manner of position regulation of strain leg in connection to the strain leg holder FIG. 6—showing the shoulder rest in the widest adjustment position FIG. 7—showing the shoulder rest in the position for keeping The shoulder rest is made of shoulder rest basis 1, strain leg holder 2, strain leg 4 and nut for fixing 3.

Plastic basis of the shoulder rest is physiologically curved so it fits to the body of a violinist. At the back side of the shoulder rest 1 there is neoprene rubber 5 stuck on the instrument which enables the soft amortisation of shoulder rest on the violinist's shoulder.

The shoulder rest form 1 is different from the other existing shoulder rests in the way that the right side is partially rolled up in the opposite direction and thus it enables maximal adjustment to physical characteristics of the violinist.

The strain leg holder 2 is made of spring steel which presents the elastic link between the basis of the shoulder rest 1 and the strain leg 4. the holder of strain leg 2 has s boring 9 through which it can be fixed on the basis of the shoulder rest 1 by means of the nut 3 and the screw 6 The cylinder with a coil 7 is put into the semicircle of the strain leg holder and it fastens the holder of strain leg 10. An oval hole 8 and a groove 11 fit dimensionally to the holder of strain leg 10 in order that the strain leg 4 can move or shift in a very wide range of field and enables adjustment of strain leg 4 in the widest part of the violin. This prevents to the shoulder rest to fall off the instrument while playing it and it makes sure and it also enables the optimal position for the instrument according to the violinist's needs.

Fastening of strain leg 4 on the holder of strain leg 2 prevents any falling of the shoulder rest off the instrument. Length adjustment of the shoulder rest along the longitudinal axis enables the strain leg holder 2, which can be rotated for 180° C. in both directions—left and right in the was to loosen the fixing nut 3.

The advantage of fixing the strain leg 4 on the holder 2 is the possibility of putting the shoulder rest together according to the rest's height and that enables the oval hole 8 and the groove 11 on the strain leg holder 2.

The shoulder rest according to this invention is made up in the manner that the left and the right strain leg holder is fastened on the basis of the shoulder rest 1 by means of the screws 6 and the nuts 3. In the left and right strain leg holders 2 we put the cylinder with coil 7 and we wind round the holder of the strain leg 10.

The invention claimed is:

1. A shoulder rest for a violin and a viola comprising:

a shoulder rest board having a first end and a second end;

a first strain leg holder having a coupling axis, an extension arm and a first strain leg coupled thereto configured to retain an edge of a sound board of a violin or a viola;

a second strain leg holder having a coupling axis, an extension arm and a second strain leg configured to retain another edge of a sound board of a violin or a viola;

the first strain leg holder is coupled by its axis to the first end of the shoulder rest board wherein the first strain leg holder is rotationally positionable about its axis relative to the shoulder rest board through an arcuate distance of 360°, independent of the pivoting or rotation of the first strain leg relative to the first strain leg holder extension arm and the second strain leg holder is coupled by its axis to the second end of the shoulder rest board wherein the second strain leg holder is rotatably positionable about its axis relative to the shoulder rest through an arcuate distance of 360°, independent of the pivoting or rotation of the second strain leg relative to the second strain leg holder extension arm.

2. The shoulder rest of claim 1 wherein each strain leg holder comprises a planar member with a semicircle at a far end thereof, each strain leg further includes a cylinder substantially complementary to the semicircle of the strain leg holder, to be captured therein, and to, in turn, couple the strain leg to the strain leg holder, while allowing relative movement thereof.

* * * * *